United States Patent [19]

Hashimoto

[11] 4,226,524

[45] Oct. 7, 1980

[54] MAGNETIC BRUSH DEVELOPMENT APPARATUS FOR AN ELECTROSTATIC COPIER

[75] Inventor: Makoto Hashimoto, Kawasaki, Japan

[73] Assignee: Ricoh Company, Ltd., Tokyo, Japan

[21] Appl. No.: 958,725

[22] Filed: Nov. 8, 1978

[30] Foreign Application Priority Data

Nov. 19, 1977 [JP] Japan ..... 52-139139
Nov. 21, 1977 [JP] Japan ..... 52-139756

[51] Int. Cl.[2] ..... G03G 15/00; G03G 15/09

[52] U.S. Cl. ..... 355/3 DD; 118/657; 118/658

[58] Field of Search ..... 355/3 R, 3 DD; 118/657, 118/658

[56] References Cited

U.S. PATENT DOCUMENTS

| | | | |
|---|---|---|---|
| 3,572,288 | 3/1971 | Turner | 118/657 |
| 3,926,517 | 12/1975 | Nagahara | 355/3 DD |
| 3,970,036 | 7/1976 | Baer et al. | 118/7 |
| 4,048,958 | 9/1977 | Nagaguchi et al. | 118/658 |

FOREIGN PATENT DOCUMENTS

| | | | |
|---|---|---|---|
| 2528864 | 1/1976 | Fed. Rep. of Germany | 355/3 DD |

OTHER PUBLICATIONS

Freeman et al; "Magnetic Brush Unit with Magnetic Conveyor", IBM Technical Disclosure Bulletin; vol. 15, No. 4, Sep. 1972, pp. 1251–1252.

Daniels et al; "Magnetic Conveyor Roll", IBM Technical Disclosure Bulletin; vol. 17, No. 3, Aug. 1974, pp. 675–676.

Daniels et al; "Magnetic Brush Developer", IBM Technical Disclosure Bulletin; vol. 18, No. 8, Jan. 1976, pp. 2413–2414.

*Primary Examiner*—Fred L. Braun

*Attorney, Agent, or Firm*—Cooper, Dunham, Clark, Griffin & Moran

[57] ABSTRACT

The magnetic brush development apparatus comprises two magnetic rollers, namely a development roller for developing a latent electrostatic image and a developer feed roller for supplying a magnetic developer to the development roller. The quantity of the magnetic developer transferred from the developer feed roller to the development roller is initially regulated by a particular arrangement of the magnets disposed in the development roller and the developer feed roller. Furthermore, the quantity of the magnetic developer on the development roller is regulated by a doctor member prior to development. In order to keep the bulk density of the developer on the development roller constant, a preliminary pressure plate is provided for applying pressure to the developer on the development roller so that a uniform and high bulk density magnetic brush is formed on the development roller.

10 Claims, 14 Drawing Figures

MAGNETIC BRUSH DEVELOPMENT APPARATUS FOR AN ELECTROSTATIC COPIER

BACKGROUND OF THE INVENTION

The present invention relates to a magnetic brush development apparatus for developing a latent electrostatic image for use with an electrophotographic copying apparatus and an electrostatic recording apparatus.

In the conventional development apparatus of a magnetic brush development type, a latent electrostatic image is developed by one development roller which is capable of scooping up a developer. Recently, however, there has been a great need and demand for a high speed copying and maintenance-free machine on the market. By a "maintenance-free" copying machine here is meant a machine which can be used without frequent attention to maintenance operations on the machine, such as exchanging the developer. In order to meet such a demand on the market, it would appear to be necessary to increase the quantity of the developer that can be held in the development apparatus. Of course, there could be some other preferable way to meet the demand on the market, such as by improving the developer. However, it has not been accomplished yet. In the method of increasing the quantity of the developer that can be held in the development apparatus, the aim is to reduce the number of circulation cycles of the developer by increasing the quantity of the developer in the development apparatus, so that a fatigue of the developer, particularly a fatigue of carriers, is obviated as much as possible. The fatigue and deterioration of the carrier is promoted by the contact of the carriers with other materials and the carriers themselves. The developer which has been used in development is rested for a while. Therefore, in the development apparatus of a high speed copying machine, the developer is circulated at a high speed, but the quantity of the developer held in the development apparatus is so large that a considerable change of the concentration of toner in the developer does not occur and the fatigue and deterioration of the developer can be reduced and, accordingly, the period between the exchange of the developer can be considerably lengthened. However, as the quantity of the developer held in the development apparatus is increased, the development apparatus has to become oversized. In this case, when one development roller is employed as in the conventional development apparatus, a long development roller has to be employed. As a result, the length of the development roller causes a difficult problem in the overall layout of a copying macine employing such a development roller. Furthermore, in this case, the developer has to be carried from a distant portion with stirring by a developer transporting apparatus. During the transportation, the developer receives a mechanical friction and is deteriorated. In particular, in a dry type development apparatus, all of the developer has to be circulated. Otherwise, the developer coagulates and accordingly it cannot be used any longer.

Under such circumstances, the development apparatus as illustrated in FIGS. 1 and 2 have been proposed.

In FIG. 1, there is shown a multi-magnetic brush development apparatus. Reference numeral 1 indicates a photoconductor drum which is rotated in the direction of the arrow. A development apparatus 2 comprises three development rollers 3, 4 and 5, each of which comprises a non-magnetic sleeve and a magnet and which are rotatable in the direction of the respective arrows in close proximity to the photoconductor drum 1. The development roller 3 scoops up the developer placed in a bottom portion of the development apparatus 2 and supplies the developer to the development roller 4, which developer is transferred from the development roller 4 to the development roller 5 and from all of the rollers to drum 1, so that a latent electrostatic image on the photoconductor drum 1 is developed by the development rollers 3, 4 and 5. The developer that has not been used in the development is scraped from the development roller 5 by a developer scraping plate 6 and the thus scraped developer is dropped into a developer holding portion 7. A predetermined quantity of the developer is then supplied to the development roller 3 through a gap 7*a* from the developer holding portion 7. In this development apparatus, it is difficult to keep the amount of the developer constant on each development roller since there is no doctor member before the development station. In particular, in the method for transporting the developer from one development roller to the other development roller, the magnetic brush of the developer on each development roller gradually becomes higher and accordingly the bulk density of the toner of the magnetic brush is lowered. Therefore, the gap between each development roller and the photoconductor drum 1 has to be adjusted. Thus, the magnetic transport of the developer is apt to bring about an unstable flow of the developer and it is difficult to make a uniform magnetic brush and to perform a uniform development.

Futhermore, a development apparatus 10 as shown in FIG. 2 has been proposed. In FIG. 2, the development apparatus 10 comprises one development roller 8 and a developer feed roller 9. The developer is magnetically transported from the developer feed roller 9 to the development roller 8. Also in this case, it is difficult to form a uniform magnetic brush on the development roller 8. In order to remove the difficulty, it has been proposed to dispose a doctor member in close proximity to the developer feed roller 9. However, even with such an arrangement it is difficult to make the height of the magnetic brush uniform at the time of development.

As a result, it might be proposed to dispose a doctor member in close proximity to the development roller 8 of the development apparatus 10 in FIG. 2. In such case, any excessive developer removed by the doctor member will gradually build up and there is no room for the removed developer, and a great load is applied to the development roller 8 and to the developer itself, so that the deterioration of the developer is promoted.

Referring to FIG. 5, there is shown a further conventional development apparatus. In the figure, a development apparatus 102 is disposed under the left side of a photoconductor drum 101, and a magnetic brush is formed on a development roller 103 having a magnet therein and a latent electrostatic image on the photoconductor drum 101 is developed by the magnetic brush. In a developer container 104 for holding a developer therein, two doctor members 105 and 106 are disposed so as to face the development roller 103. The doctor member 105 serves to regulate the quantity of the developer supplied to the development roller 103, while the doctor member 106 regulates the amount of the developer suitably for performing development in a gap between the photoconductor drum 101 and the development roller 103. Another role of the doctor member 105 is to prevent the reactive torque on the development roller 103 from increasing by the building up of the developer between the development roller 103 and the developer container 104 when an excessive amount of the developer is removed from the development roller 103 by the doctor member 106.

Referring to FIG. 6, there is shown a still further conventional development apparatus. In the figure, under a development roller 107, there is disposed a developer feed roller 108, which magnetically scoops up the developer placed in a developer container 109 and transports magnetically all of the scooped developer to the development roller 107. In this development apparatus, a doctor member 110 is disposed in close proximity to the development roller 107 before a development station so that the quantity of the developer for development is regulated. However, since the magnetic developer on the development roller 107 is magnetically transported against its weight from the developer feed roller 108, the bulk density of the magnetic brush is lowered at the time of development even if the height of the magnetic brush is regulated by the doctor member 110.

In the case of a developer comprising resincoated magnetic carriers and a toner, the carriers are expanded by an electrostatic repulsion between the carriers while the developer is stirred. As a result, the bulk density of the developer decreases. The inventor of the present invention stirred a developer comprising the coated carriers and 1.5 weight percent of toner and measured the bulk density of the developer. As shown in FIG. 7, the bulk density of the developer became smaller with time by the expansion of the developer and, in about 30 minutes, the expansion of the developer was saturated. The bulk density of the developer is also decreased while the developer is scooped up and transferred between the magnetic rollers and is caused to pass over a plurality of magnetic poles. In the development apparatus as shown in FIG. 2, the expansion of the developer occurs even in the case of a two-component type developer comprising an ordinary toner and iron powders since the developer is scattered within the development apparatus and accordingly the bulk density of the developer decreases.

When the bulk density of the developer decreases, the magnetic brush formed by the developer becomes coarse and non-uniform development and insufficient image density occur.

SUMMARY OF THE INVENTION

It is therefore a primary object of the present invention to provide a development apparatus capable of forming a uniform magnetic brush.

Another object of the present invention is to provide a development apparatus capable of increasing the bulk density of a developer on a development roller so as to obtain a uniform image.

In one embodiment of a development apparatus according to the present invention, when a magnetic brush is formed on a magnetic development roller, the quantity of the developer transferred from a developer feed roller to a development roller is adjusted magnetically by the magnets disposed inside the developer feed roller and the development roller, and the height of the magnetic brush is regulated by a doctor member prior to development. Furthermore, two development circulation paths are formed in the development apparatus, so that the developer is circulated automatically in the development apparatus, whereby the rotation of the developer feed roller and the development roller is made uniform and a uniform image density is attained.

In another embodiment of a development apparatus according to the present invention, the developer which has expanded by an electrostatic force generated between the carriers of the developer is pressed by a preliminary pressure plate prior to development so that the bulk density of the developer on the development roller is made uniform and a uniform magnetic brush is then formed on the development roller. The preliminary pressure plate is swingably moved automatically in accordance with the quantity of the developer on the development roller so as to form a magnetic brush with a predetermined uniform bulk density, whereby a latent electrostatic image on a photoconductor drum is brushed uniformly by the magnetic brush and accordingly a uniform image can be obtained. Furthermore, this embodiment is designed so that all of the developer in the development apparatus is circulated uniformly, whereby deterioration of the developer is obviated.

BRIEF DESCRIPTION OF THE DRAWINGS

For a better understanding of the invention as well as the objects and other features, reference will be had to the following detailed description which is to be read in conjunction with the drawings wherein.

DETAILED DESCRIPTION OF THE PREFERRED EMBODIMENTS

Figure 3:
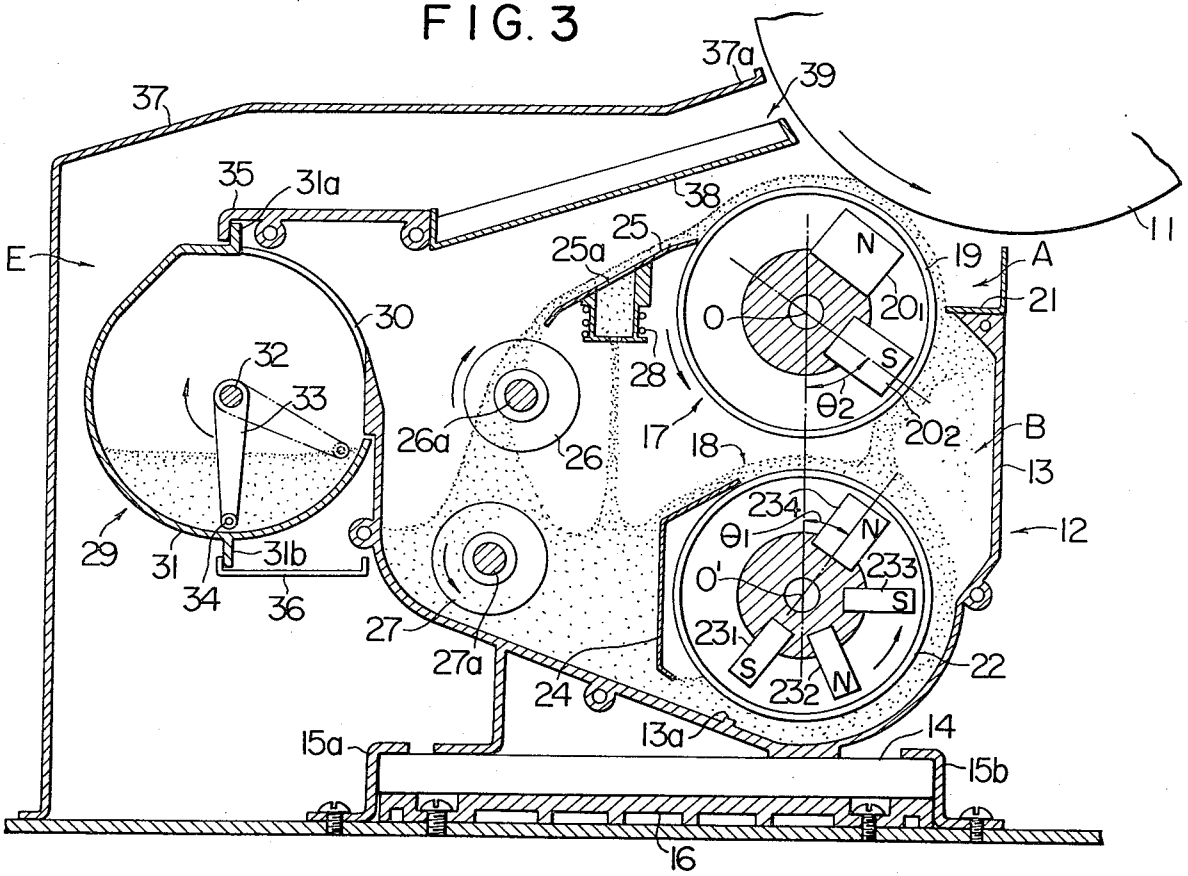
FIG. 3 is a schematic sectional side view of an embodiment of a development apparatus according to the present invention.

Referring to FIG. 3, there is shown a schematic sectional view of an embodiment of a development apparatus according to the present invention. In the figure, reference numeral 11 represents a photoconductor drum, which is rotated in the direction of the arrow at a predetermined speed. As the photoconductor for use in the photoconductor drum 11, inorganic photoconductors, such as zinc oxide, selenium and CdS, or organic photoconductors or photoconductors prepared with a combination of inorganic and organic photoconductors can be employed. In the present invention, the photoconductor is not limited to the drum-shaped photoconductor as in the present embodiment, but a flexible belt-shaped photoconductor can be employed as well. After a latent electrostatic image is formed on the photoconductor drum 11 by charging and exposure of the photoconductor drum 11, the latent electrostatic image is developed by toner powder. A development apparatus 12 is disposed under the photoconductor drum 11, where the peripheral surface of the photoconductor drum 11 moves downwards. A development container 13 is supported on a supporting plate 14. The supporting plate 14 can be drawn to the front side of the copying machine along guide members 15*a* and 15*b* which are attached to the body of the copying machine and along a bottom guide member 16. The development apparatus 12 is held in place by the guide members and can be drawn along them so that it can be detached from the body of the copying machine. Inside the development container 13, there are disposed a development roller 17 and a developer feed roller 18. The development roller 17 is situated above the developer feed roller 18. The development roller 17 comprises a non-magnetic rotary sleeve 19, whose surface is knurled double-cut-wise, and magnets $\mathbf{20}_1$ and $\mathbf{20}_2$ which are fixedly disposed inside the non-magnetic rotary sleeve 19. The magnet $\mathbf{20}_1$ has its north pole facing the photoconductor drum 11 and has approximately 450 G of magnetic force, while the magnet $\mathbf{20}_2$ is disposed almost normal to the magnet $\mathbf{20}_1$ with its south pole facing drum 11 and the magnetic force of the magnet $\mathbf{20}_2$ is 750 G. The sleeve 19 is rotated at a speed of 120 to 170 rpm with an approximately 2 to 3 mm gap between the surface of the sleeve 19 and that of the photoconductor drum 11. On one side of the development roller 17, there extends a doctor member 21 parallel to the shaft of the sleeve 19. The gap between the tip of the doctor member 21 and the sleeve 19 is set slightly smaller than the gap between the photoconductor drum 11 and the sleeve 19. The doctor member 21 is angle-shaped, and the developer which is scattered when passing through the doctor member 21 is caught in a space A formed by the doctor member 21, the sleeve 19 and the photoconductor drum 11, so that the developer is prevented from being scattered outside the development apparatus 12.

Figure 4:
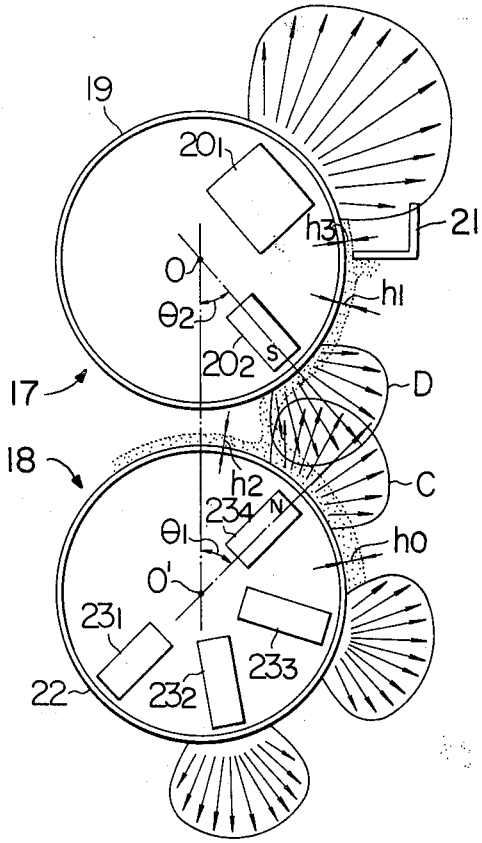
FIG. 4 is a schematic sectional side view of a development roller and a developer feed roller in the embodiment of FIG. 3 for explaining a principle of the present invention.

Under the development roller 17, there is disposed the developer feed roller 18, which consists of a non-magnetic rotary sleeve 22 and four magnets $\mathbf{23}_1$–$\mathbf{23}_4$ which are fixedly disposed inside the non-magnetic rotary sleeve 22. The magnets $\mathbf{23}_1$–$\mathbf{23}_4$ for feeding the developer to the development roller 17 are disposed in such a manner that their magnetic poles are alternately reversed with an equal angle therebetween. Each magnetic force of the magnets $\mathbf{23}_1$–$\mathbf{23}_3$ is 550 G, while the magnetic force of the magnet $\mathbf{23}_4$ is 750 G. The magnet $\mathbf{20}_2$ and the magnet $\mathbf{23}_4$ are respectively slanted about 54° to 56° from a line connecting the rotating center of the sleeve 19 and that of the sleeve 22 as shown in FIGS. 3 and 4, wherein, $\theta_1=\theta_2=54°-56°$. The gap between the sleeve 22 and the sleeve 19 is about 7 mm. The sleeve 22 and the sleeve 19 are rotated at the same speed. In the bottom portion of the developer container 13, there is provided a projection 13*a* which extends in the axial direction of the sleeve 22. The gap between the projection 13*a* and the surface of the sleeve 22 is about 4 mm. In FIG. 3, on the left side of the sleeve 22, there is provided a developer scraping plate 24, which comprises a vertical portion and bent end portions on opposite sides of the vertical portion. One end portion is in close proximity to or in contact with the surface of the sleeve 22 in order to remove the toner from the surface of the sleeve 22, and the other end is spaced approximately 5 mm from the bottom of the developer container 13 in order to regulate the flow of the developer held in the developer container 13.

Furthermore, on the upper left side of the development roller 17, there is disposed a developer scraping plate 25 in close proximity to or in contact with the sleeve 19. The developer scraping plate 25 serves to remove the used developer from the surface of the sleeve 19 at a portion where the magnetic force of the magnet $\mathbf{20}_1$ does not reach the developer, so that the developer is caused to fall down under its own weight along the upper surface of the developer scraping plate 25. The used developer is thus returned to the developer container 13. Under the rear end portion of the developer scraping plate 25, there is disposed a stirring impeller 26 which is driven clockwise by a driving apparatus that rotates a shaft 26*a*. The stirring impeller 26 comprises a plurality of oval plates which are slantingly attached to the shaft 26*a*, with equal spaces therebetween. Therefore, whenever the stirring impeller 26 is rotated by 180°, the slanting direction of the oval plates is reversed, whereby the developer is stirred in the axial direction of the stirring impeller 26.

The developer is held in a space between the bottom of the developer container 13 and the vertical portion of the developer scraping plate 24. The developer recovered by the developer scraping plates 24 and 25 is placed in this space. In this space, a stirring impeller 27 is disposed so as to be rotatable counterclockwise. The stirring impeller 27 is designed so as to direct the developer to the middle portion of a shaft 27*a* of the stirring impeller 27 by disposing two spiral members with different winding directions on the first half portion and the second half portion of the shaft 27*a*, respectively.

In the central portion of the developer scraping plate 25, there is formed a hole 25*a*. Under the hole 25*a*, there is provided a magnetic toner concentration sensor 28 comprising a non-magnetic cylinder and a coil wound around the non-magnetic cylinder. The used developer from the hole 25*a* passes through the non-magnetic cylinder, where the mixing ratio of the toner and the carrier of the developer is detected from the change of the inductance of the coil. When it is detected that the mixing ratio of the toner becomes less than a predetermined mixing ratio, a toner replenishment signal is produced by a control apparatus (not shown).

Behind the development apparatus 12, there is disposed a toner replenishment apparatus 29. The toner replenishment apparatus 29 comprises a cylinder 31 having a long and narrow opening 30 for supplying toner therefrom in an upper portion of the cylinder 31, a pair of arms 33, which are rotated clockwise on a shaft 32 in the cylinder 31, and a coil spring 34 stretched between the arms 33. Toner powder is placed in the cylinder 31. Normally, the arms 33 are placed on the top surface of the toner powder under the weight of the arms 33 themselves as indicated by dot-and-dash lines, so that the quantity of the toner remaining in the cylinder 31 can be detected by remaining toner quantity detecting apparatus (not shown) from the position of the arms 33. The arms 33 and the coil spring 34 are rotated by a driving apparatus connected to the shaft 32, so that the toner is trapped within the coil spring 34 and is replenished therefrom into the development apparatus 12 through the opening 30 by centrifugal force. When the arms 33 are rotated to the uppermost position, the driving force is disconnected from the arms 33, but the arms 33 are continuously rotated by their inertia and are then stopped on the upper surface of the toner in the cylinder 31. The coil spring 34 is also rotated, taking a concentric path, with a slight space from the inside of the cylinder 31. When the toner is replenished, since the coil spring 34 passes through the toner, the toner is stirred suitably. This prevents the toner from clinging or remaining unused in the cylinder 31. Furthermore, since the replenishment of the toner is performed by scattering the toner using centrifugal force, the toner is suitably distributed in the development apparatus 12 and clumps of the developer are advantageously made into powders. On the upper side and the lower side of the cylinder 31, there are formed guide plates 31*a* and 31*b*, which are guided along guide rails 35 and 36 provided in the development apparatus 12. When the toner is supplied into the toner replenishment apparatus 29, the toner replenishment apparatus 29 is pulled forwards along the guide rails 35 and 36 and the toner is supplied into the cylinder 31 from the opening 30 without detaching the cylinder 31 from the development apparatus 12. At this time, the shaft 32 is disconnected from the driving apparatus provided in the development apparatus 12 or the body of this copying machine. It is convenient to design the cylinder 31 so as to be rotated counterclockwise so that the opening 30 comes to the top of the cylinder 31 when the toner is supplied into the cylinder 31. Such a rotatable cylinder 31 can be designed so as to be rotated after the toner replenishment apparatus 29 has been completely pulled out or as the toner replenishment apparatus 29 is pulled out. Advantageously, since the opening 30 also serves as an opening for supplying toner into the cylinder 31 and is formed in an upper portion of the cylinder 31, toner does not come from the cylinder 31 even when the toner replenishment apparatus 29 is pulled out or when the copying machine is vibrated. In the development apparatus according to the present invention, a magnetic developer is employed, which is the so-called two-component type developer comprising a non-magnetic toner and a magnetic carrier (iron powders). As the magnetic carrier, iron powders or resin-coated iron powders are employed. Instead of the non-magnetic toner, the conventional magnetic toners can be employed. The developer held in the developer container 13 is prevented from being brought into contact with the developer feed roller 18 by the developer scraping plate 24, so that an unnecessary mechanical friction of the developer and deterioration of the carrier and increase of the torque of the developer feed roller 18 are prevented. A necessary amount of the developer is attracted to the developer feed roller 18 by the magnetic force of the magnet $\mathbf{23}_1$ and the amount of the developer on the developer feed roller 18 is controlled appropriately by the projection 13*a*. The developer is attracted to the sleeve 22 by the magnetic attraction of the magnets $\mathbf{23}_1$, $\mathbf{23}_2$, $\mathbf{23}_3$, and $\mathbf{23}_4$ so that the developer is scooped up in the rotating direction of the sleeve 22, and at a portion where the magnetic field of the magnet $\mathbf{23}_4$ of the developer feed roller 18 and that of the magnet $\mathbf{20}_2$ of the development roller 17 overlap, part of the developer on the sleeve 22 is magnetically transferred onto the sleeve 19 and the developer remaining on the sleeve 22 is scraped from the sleeve 22 by the developer scraping plate 24. The developer supplied to the development roller 17 forms magnetic brushes on the sleeve 19 and moves in the rotating direction of the sleeve 19 and, prior to development, the height of the magnetic brushes is regulated at a predetermined height by the doctor member 21, so that any excessive amount of the developer is removed by the doctor member 21 and is caused to fall on the developer feed roller 18 as illustrated in FIG. 3, and is again carried upwards by the developer feed roller 18. However, since the quantity of the developer supplied is always made constant by the projection 13*a*, a space B formed between the developer feed roller 18 and the development roller 17 is filled with the excessive developer in the course of a long copying process and accordingly the rotation loads of both rollers 17 and 18 increase and the rotation of the development roller 17 becomes irregular. As a result, development cannot be performed appropriately. Therefore, some means for removing gradually the accumulated developer from the space B becomes necessary. In the present invention, a space for allowing the developer to pass therethrough is formed between the development roller 17 and the developer feed roller 18 so that the gradual removal of the accumulated developer is attained by interaction of the magnet $\mathbf{23}_4$ and the magnet $\mathbf{20}_2$. Referring to FIG. 4, the principle of the interaction of the magnet $\mathbf{23}_4$ and the magnet $\mathbf{20}_2$ will now be explained.

In FIG. 4, the developer is scooped up on the sleeve 22, forming a developer layer having a thickness $h_0$, and onto the sleeve 19 of the development roller 17, there is magnetically transferred a developer against its weight and a developer layer having a thickness $h_1$ is formed, so that the developer layer having a thickness $h_2$ remains on the sleeve 22 and is moved in the rotating direction of the sleeve 22. Initially, a relationship of $h_0=h_1+h_2$ holds good. However, prior to development, the developer layer on the sleeve 19 is regulated by the doctor member 21 so that the thickness of the developer layer becomes $h_3$ and the developer corresponding to a developer layer $(h_1-h_3)$ is dropped on the sleeve 22 of the developer feed roller 18. As a result, the thickness of the developer layer on the sleeve 22 becomes $h_0+(h_1-h_3)$.

Supposing that $h_2$ is constant, an amount $$V = \int_0^t (h_1 - h_3) \cdot S dt$$

of the developer is built up in the space B, where S is a unit area of the developer in the axial direction of the sleeve 22. Strictly, the thickness of the developer layer h is also effected by the lowering of the bulk density of the developer caused by various factors, such as transporation of the developer, passage of the developer through magnetic poles and transfer of the developer from one sleeve to the other sleeve. However, for the purpose of the explanation of the basic idea in this matter, the consideration of such factors is omitted here.

Supposing that the scope of a magnetic field of the magnet $\mathbf{23}_4$, where the developer can be magnetically attracted, is C and that of the magnet $\mathbf{20}_2$ is D, since the magnetic poles of the two magnets are arranged oppositely, the S pole of the magnetic carrier on the sleeve 22 is directed to the magnet $23_4$ and the N pole of the magnetic carrier is directed to the opposite side and accordingly the magnetic carrier is magnetically attracted to the S pole of the magnet $20_2$. However, all of the magnetic carrier is not transferred to the magnet $20_2$ since the magnetic force of the magnet $23_4$ still exists, so that the magnetic carrier is transferred to the magnet $20_2$ only where the magnetic balance between the magnet $23_4$ and the magnet $20_2$ is upset. Furthermore, since the developer can remain on the sleeve 22 under the pull of gravity, the amount of the developer which can be magnetically attracted from the sleeve 22 by the magnet $20_2$ is essentially constant. Therefore, although the thickness $h_0$ of the developer layer on the sleeve 22 may be varied, the thickness of the developer transferred from the sleeve 22 to the sleeve 19 is approximately $h_1$. It follows that, when the thickness $h_0$ is varied, the thickness $h_2$ is varied in accordance with the variation of the thickness $h_0$ so that the excess developer is returned to the developer container 13 as the sleeve 22 is rotated.

Supposing that the axis of the development roller 17 is represented by 0 and that of the developer feed roller 18 is represented by 0'. Then when an angle $\theta_2$ between a line 00' and the axis of the magnet $20_2$ was set at 53°30' and an angle $\theta_1$ formed by the line 00' and the axis of the magnet $23_4$ was set at 55°, it was found that approximately $\frac{1}{3}$ to $\frac{1}{4}$ of the developer remained on the sleeve 22 without being transferred to the development roller 17. When the magnet $23_4$ was rotated clockwise so that the angle $\theta_1$ formed by the line 00' and the axis of the magnet $23_4$ was made greater, the thickness $h_1$ of the developer transferred to the sleeve 19 increased and when the magnet $23_4$ was rotated in the opposite direction, the thickness $h_2$ increased. Since such a relationship may be varied, depending upon the distance between the magnet $20_2$ and the magnet $23_4$, and their attachment angles and magnetic forces, it cannot be mathematically determined readily. However, the thicknesses $h_1$ and $h_2$ can be empirically set as desired. From the above, since the thickness $h_2$ of the developer remaining on the sleeve 22 is varied considerably, there must be a sufficient space between the sleeve 19 and the sleeve 22 so that the developer can be moved smoothly between the two sleeves 19 and 22. Now referring back to FIG. 3, the developer thus transferred to the sleeve 19 is formed into a uniform magnetic brush with an appropriate height by the doctor member 21 while passing the magnets $20_1$ and $20_2$ and is then brought into contact with the photoconductor drum 11. The developer which has passed through the development station is removed from the sleeve 19 by the developer scraping plate 25 and a small portion of the developer is returned to the developer container 13 through the toner concentration sensor 28 and the rest of the developer is scattered in the axial direction of the shaft **26*a* by the stirring impeller 26 which is rotatably mounted under the developer scraping plate 25, whereby the developer can be uniformly returned to the developer container 13 even if the toner consumption differed in the axial direction of the development roller 17** and the toner concentration of the recovered developer is not uniform.

In the bottom portion of the developer container 13, a stirring impeller 27 is rotated, partly or wholly buried in the developer. The stirring impeller 27 serves to move the developer in the direction of the middle of shaft **27*a* of the stirring impeller 27 so as to make the concentration of the toner in the developer uniform and to promote the triboelectric charging of the toner by bringing the toner and the carrier into contact. The developer is thus circulated in the development apparatus 12. Particularly, the development apparatus 12** has two circulation routes for the developer as mentioned above.

When the toner concentration sensor 28 detects that the toner concentration is lowered below a predetermined toner concentration, a predetermined amount of the toner is replenished from the toner replenishment apparatus 29 to the development apparatus 12. Since the amount of the toner replenished by one rotation of the arms 33 is several grams, the toner is replenished by rotating the arms 33 a number of times. The toner is scattered by centrifugal force and the toner concentration sensor 28 is sufficiently spaced from the toner replenishment apparatus 29, or a screen or partition plate is placed between the opening 30 for replenishing the toner and the toner concentration sensor 28 so that the toner is prevented from entering the sensor directly.

Above and on the left side of the development apparatus 12, there is disposed a shield plate 37 with a predetermined space from the development apparatus 12. The shield plate 37 is fixed to the body of the copying machine. An opening 39 facing the photoconductor drum 11 is formed by a tip **37*a* of the shield plate 37 and a lid 38 provided above the development apparatus 13. A space E formed by the shield plate 37 and the development apparatus 12 constitutes a duct for use with an air suction apparatus (not shown). Since the toner powders from the development apparatus 12 are scattered in the direction of a tangent of the photoconductor drum 11 where the development roller 17 faces the photoconductor drum 11, a lot of the toner exists in the inlet portion of the development apparatus 12 near the photoconductor drum 11. Therefore, by providing the opening 39** of the duct in the portion, the toner powders floating in the portion are sucked by the air suction apparatus, so that the adhesion of the toner particles to an exposure optical system and other systems is prevented.

In the above-mentioned embodiment of a development apparatus according to the present invention, in order to change the amount of the developer fed from the sleeve 22 to the sleeve 19 or the amount of the developer returned to the developer container 13 by the sleeve 22, the magnets $23_1$–$23_4$ or only the magnet $23_4$ inside the sleeve 22 can be wholly displaced by a knob (not shown) provided outside the development apparatus 12. As a matter of course, by providing an apparatus for detecting the quantity of excess developer accumulated in the space B of the development apparatus 12, and by rotating or displacing the magnet $23_4$ automatically prior to an abnormal accumulation of the developer, the quantity of the developer recovered by the sleeve 22 can be increased. As the apparatus for detecting the quantity of the excessive developer, an apparatus comprising a sound generator and a receiver, and the conventional photoelectric developer detecting apparatus and the conventional magnetic developer detecting apparatus can be employed.

Figure 8:
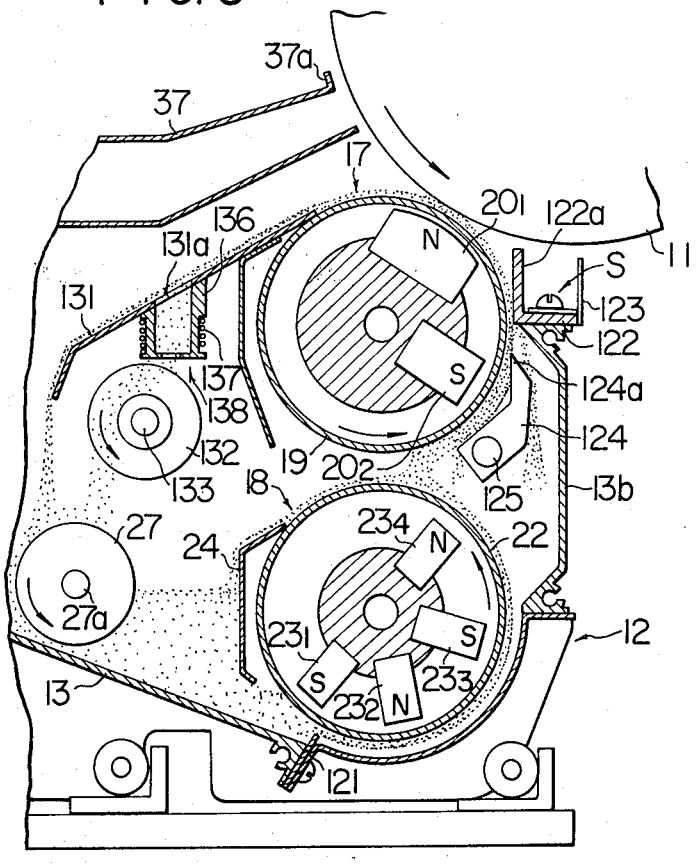
FIG. 8 is a schematic partial sectional view of a further embodiment of a development apparatus according to the present invention.

Referring to FIG. 8, there is shown another embodiment of a development apparatus according to the present invention. In the figure, the members or apparatuses which are substantially identical to those in the embodiments as shown in FIG. 3 are given the same reference numerals.

In FIG. 8, at a bottom portion of the developer container 13, there is disposed a first doctor member 121, for regulating the amount of the developer transported by the developer feed roller 18, in close proximity to the developer feed roller 18, and on a side wall of the developer container 13, there is disposed a second angle-shaped doctor member 122 in close proximity to the development roller 17.

Figure 9:
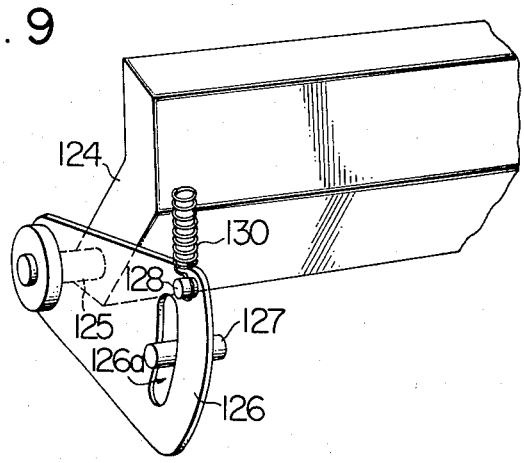
FIG. 9 is a schematic perspective view of a preliminary pressure plate for use in the development apparatus of FIG. 8.

In the second doctor member 122, a portion 122*a* which faces the development roller 17 extends in the direction of a tangent of the development roller 17 so as to come in close proximity to the photoconductor drum 11. A plate 123 disposed parallel to the portion 122*a* is attached to the other side of the second doctor member 122 so that a space S is formed between the portion 122*a* and the plate 123. On the side wall of the developer container 13, there is formed a comparatively broad concave portion 13*b* which covers the development roller 17 and the developer feed roller 18. Inside the concave portion, there is disposed a preliminary pressure plate 124 in close proximity to the second doctor member 122. The preliminary pressure plate 124 is rotatable on a shaft 125. The preliminary pressure plate has an acute tip 124*a* and is bent in the middle portion. Referring to FIG. 9, the shaft 125 is fixed to a base portion of the preliminary pressure plate 124 and, on the shaft 125, there is fixed a fan-shaped plate 126. The shaft 125 is rotatably supported by a side wall (not shown) of the development apparatus 12.

In the fan-shaped plate 126, there is formed a slot 126*a*, and a fixed guide pin 127 is inserted into the slot 126*a*. The fan-shaped plate 126 is movable under the guidance of the fixed guide pin 127. A pin 128 is fixed to the fan-shaped plate 126, and a coil spring 130 is stretched between the pin 128 and a pin 129 (FIG. 12) fixed to the side wall 13*b*. The preliminary pressure plate 124 is urged so as to rotate counterclockwise on the shaft 125 under the bias of the coil spring 130. The preliminary pressure plate 124 is made of a non-magnetic material, such as aluminum.

Referring to FIG. 8, a developer feed route is formed between the preliminary pressure plate 124 and the development roller 17, and a developer feed-back route is formed between the preliminary pressure plate 124 and the side wall 13*b*. The slot 126*a* formed on the fan-shaped plate 126 is for regulating the rotation of the fan-shaped plate 126 in order to prevent the tip 124*a* of the preliminary pressure plate 124 from coming into contact with the sleeve 19 when there is no developer on the sleeve 19, and also in order to prevent the base portion of the preliminary pressure plate 124 from coming into contact with the sleeve 19 by the preliminary pressure plate 124 being rotated clockwise against the bias of the spring coil 130 when the developer exists excessively on the sleeve 19.

Figure 10:
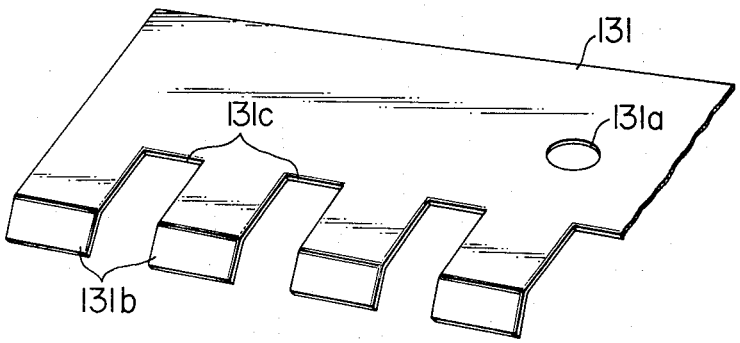
FIG. 10 is a schematic partial perspective view of a developer scraping member for use in the development apparatus of FIG. 8.
Figure 11:
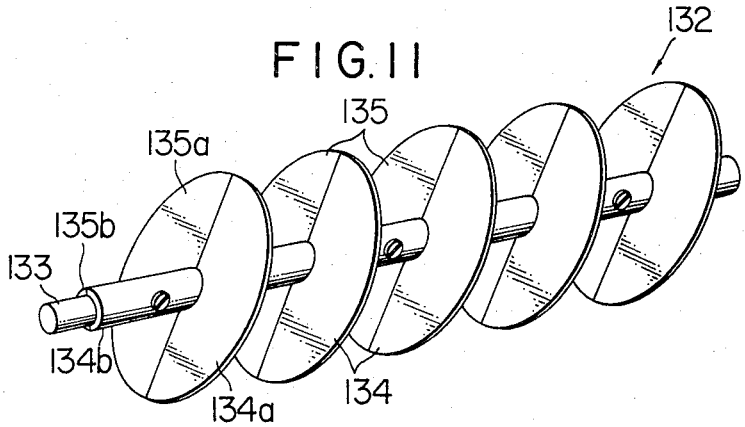
FIG. 11 is a schematic perspective view of a stirring impeller for use in the development apparatus of FIG. 8.

The developer which has passed through the development station on the sleeve 19 is removed from the sleeve 19 by a developer scraping member 131 and passes thereover and is returned to the developer container 13. As shown in FIG. 10, in the central portion of the developer scraping member 131, there is formed a small hole 131*a* and, at the rear end of the developer scraping member 131, there are formed a plurality of projections 131*b* by cutting the rear end of developer scraping member 131 like a comb with equal spaces, and the top portions of the projections 131*b* are bent downwards. During the flow of the scraped developer over scraping member 131, a part of the developer moves along the projections 131*b* and the rest of the developer is dropped from notched portions 131*c*. In the path of the developer which falls from the notched portions 131*c*, stirring impeller 132 is disposed, which is designed to rotate in the direction of the arrow. As illustrated in FIG. 11, the stirring impeller member 132 consists of first stirring impellers 134 and second stirring impellers 135, which are fixed to a shaft 133 by screws.

The first stirring impellers 134 comprise a number of half-oval wings 134*a* which are cut in the direction of the major axis, and a shaft 134*b* which is integral with the wings 134*a*. Likewise, the second stirring impellers 135 comprise a number of similar half-oval wings 135*a* and a shaft 135*b* which is integral with the wings 135*a*. By combining both stirring impellers 134 and 135 so as to hold the shaft 133, a number of slanting segmented oval plates are constructed on the shaft 133.

Figure 1:
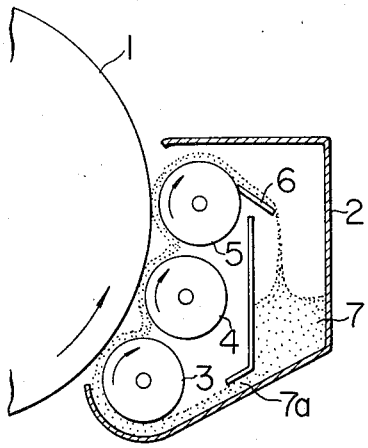
FIG. 1 PRIOR ART
FIG. 1 is a schematic sectional side view of a conventional development apparatus.
Figure 2:
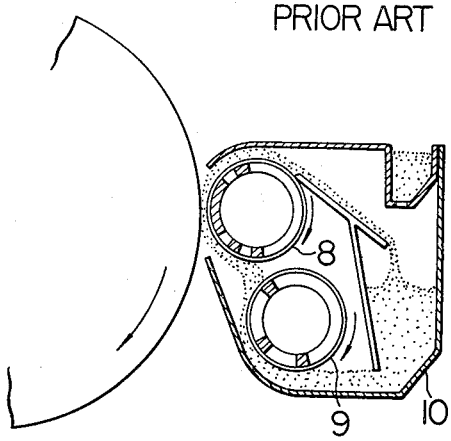
FIG. 2 PRIOR ART
FIG. 2 is a schematic sectional side view of another conventional development apparatus.
Figure 6:
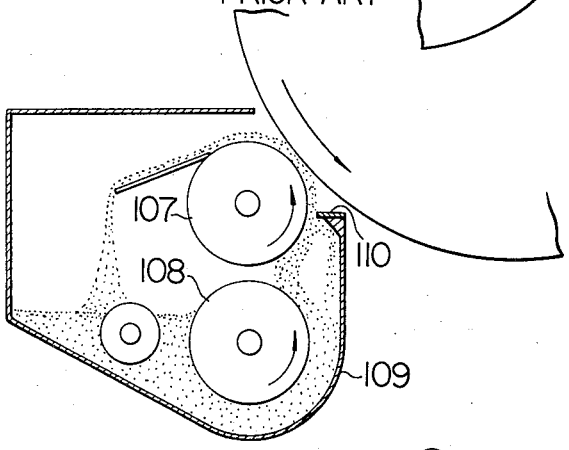
FIG. 6 PRIOR ART
FIG. 6 is a schematic sectional side view of a still further conventional development apparatus.
Figure 12:
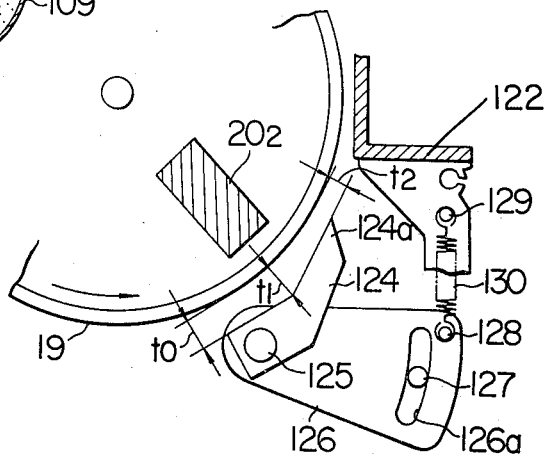
FIG. 12 is a schematic sectional view of the preliminary pressure plate for use in the development apparatus of FIG. 8.

The conventional stirring apparatuses can also be employed for this purpose. When the thus constructed stirring impeller member 132 is rotated, the slanting direction of the wings of the stirring impellers 134 and 135 are reversed with every half rotation (180°), so that the developer dropped from the developer scraping member 131 is distributed equally to the opposite axial directions of the shaft 133. The stirring impeller member 132 can be disposed in the path of the developer which is dropped from the projections 131*b* of the developer scraping member 131. Under the small hole 131*a* of the developer scraping member 131, there is disposed a non-magnetic cylinder 136, around which a coil 137 is wound. This constitutes a toner concentration detecting apparatus 138 for determining the concentration of the toner in the developer which passes through the cylinder 136 by detecting a change of the magnetic permeability of the developer. In FIG. 8, the developer in the developer container 13 is magnetically attracted to the developer feed roller 18 and is then transferred to the sleeve 19 of the development roller 17. A magnetic brush formed on the sleeve 19 is pressed by the preliminary pressure plate 124 so that the density of the magnetic brush is increased. Referring to FIG. 12, the distances from the sleeve 19 to the base portion, the central portion and the tip portion 124*a* of the preliminary pressure plate 124 are $t_0$, $t_1$ and $t_2$, respectively and they are set so as to be $t_1 > t_0 > t_2$. The tip portion 124*a* with the space $t_2$ from the sleeve 19 serves to apply pressure to the developer on the sleeve 19 and to rotate the preliminary pressure plate 124 on the shaft 125 in accordance with the quantity of the developer on the sleeve 19. The distance $t_1$ from the sleeve 19 to the central portion of the preliminary pressure plate 124 is set greater than the distances $t_0$ and $t_2$. This is because the central portion of the preliminary pressure plate 124 faces the magnet $20_2$ so that the height of the magnetic brush on the sleeve 19 becomes greatest. Therefore, application of an unnecessary pressure to the magnetic brush has to be obviated, whereby damaging the developer and causing fatigue of the developer are prevented.

A developer having a thickness $t_0$, which has entered the gap between the preliminary pressure plate 124 and the sleeve 19, is depressed until its thickness becomes $t_2$ and is caused to pass under the preliminary pressure plate. The pressure to be applied to the developer is determined by the tension of the coil spring 130 stretched between the fan-shaped plate 126 and the side wall 13*b*. This pressure is adjustable.

Figure 13A:
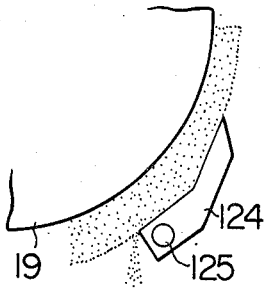
FIGS. 13(*a*) and 13(*b*) are schematic sectional views of the preliminary pressure plate of FIG. 12 for explaining its movement.
Figure 13B:
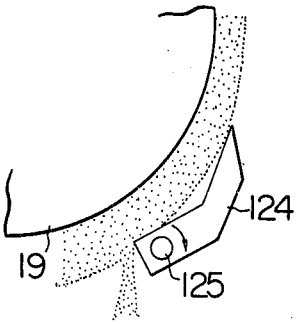
Figure 5:
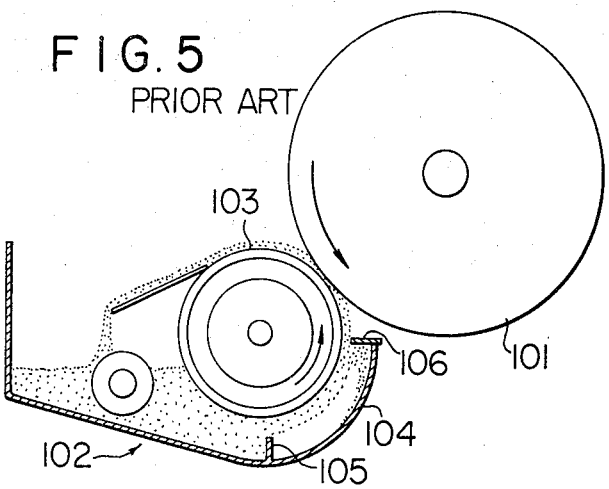
FIG. 5 PRIOR ART
FIG. 5 is a schematic sectional side view of a further conventional development apparatus.
Figure 7:
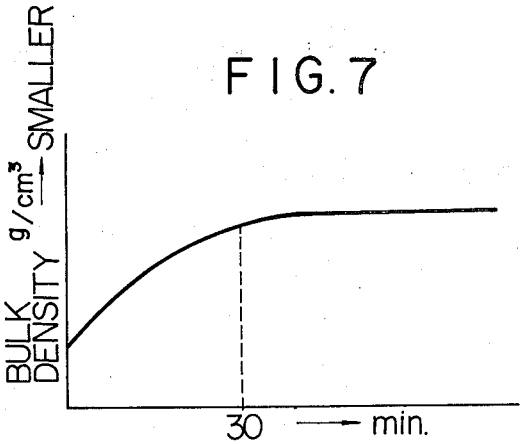
FIG. 7 shows the change of the bulk density of a developer with time.

The operation of the preliminary pressure plate 124 will now be explained by referring to FIGS. 13(*a*) and 13(*b*) FIG. 13(*a*) illustrates a state in which the developer on the sleeve 19 is slightly removed by the base portion of the preliminary pressure plate 124. When the quantity of the developer on the sleeve 19 becomes great as shown in FIG. 13(*b*) and the developer is caused to pass as it is, between the sleeve 19 and the preliminary pressure plate 124, the developer is pressed more firmly than it needs so that the bulk density of the developer becomes great and consequently the developing condition is changed. In this case, the tip 124*a* of the preliminary pressure plate 124 detects the quantity of the developer on the sleeve 19 and the preliminary pressure plate is turned clockwise on the shaft 125 so as to be spaced farther and, at the same time, the base portion of the preliminary pressure plate draws near the sleeve 19. In other words, $t_0$ which has been explained in FIG. 8 becomes smaller. As a result, an upper layer of the developer on the sleeve 19 is scraped greatly so that an excessive amount of the developer does not enter under the preliminary pressure plate 124. Thus, the quantity of the developer on the sleeve 19 is automatically detected and controlled by the preliminary pressure plate 124 and, at the same time, the developer on the sleeve 19 is pressed to a predetermined bulk density as much as possible. The height of the magnetic brush formed by the developer thus pressed to a predetermined bulk density is regulated by the second doctor member 122. The excessive developer removed by the second doctor member 122 is separated from the developer scooped from the sleeve 19 by the preliminary pressure plate 124 and is caused to fall down through the developer feed-back route formed by the preliminary pressure plate 124 and the side wall 13*b* and builds up on the developer feed roller 18. As such a cycle is repeated, the developer gradually builds up in the space formed by the development roller 17 and the developer feed roller 18 and the side wall 13*b*, so that the load on the development roller increases. As a result, the rotating speed of the development roller is varied or the developer deteriorates. However, such disadvantages are removed by spacing sufficiently the developer feed roller 18 and the development roller 17 so as to allow the developer to pass easily between the development roller and the developer feed roller 18 and to return to the developer container 13. But, the spacing of the development roller 17 and the developer feed roller 18 is determined by the configuration of the magnets $23_4$ and $20_2$ and their respective magnetic forces. In the case where the magnets are closely disposed, all of the developer on the sleeve 22 may be magnetically transferred onto the sleeve 19, and the above-mentioned return action will not be performed. In such a case the position of the magnet $23_4$ relative to that of the magnet $20_2$ is changed, for instance, by rotating the magnet $23_4$ in the same direction as the rotating direction of the sleeve 22, so that the transfer ratio of the developer from the sleeve 22 to the sleeve 19 is gradually decreased. Therefore, by setting the position of the magnet $23_4$ relative to that of the magnet $20_2$ so that part of the developer on the sleeve 22 is not transferred to the development roller, the excessive developer does not build up in the space formed by the development roller 17 and the developer feed roller 18 and the side wall 13*b*, but it is carried out of the space through the gap between the sleeve 22 and the sleeve 19. Thus, a latent electrostatic image on the photoconductor drum 11 is developed by a magnetic brush in which the quantity of the developer is regulated as mentioned above.

In such a dry type development apparatus, there may be a risk of the toner powders being scattered from the development apparatus. In the development apparatus according to the present invention, the following two countermeasures are taken against the risk. In the first countermeasure, a second front doctor plate 122*a* and a plate 123 are disposed in proximity to the photoconductor drum 11 at an outlet portion of the development apparatus 12, and a space S is formed between the second doctor member 122*a* and the plate 123, whereby air containing toner powder passes through a small space between the photoconductor drum 11 and the second front doctor plate 122*a* and is then abruptly expanded in the space S and is returned to the small space. In the space S, most toner particles adhere to the inner walls of the space S so that the scattering of toner particles from the development apparatus is prevented. Furthermore, since the second front doctor plate 122*a* of the second doctor member 122 is disposed in the direction of a tangent of the sleeve 19, when the developer on the sleeve 19 is pressed, the pressure applied to the developer is not released quickly, but it is released gradually, so that the scattering of toner powders in this portion is significantly reduced. In the second countermeasure, the shield plate 37 is provided so that an opening of a duct is positioned at an inlet portion of the development apparatus 12. Particularly since the particles are thrown in the direction of the rotation of the sleeve 19, the toner particles are scattered considerably near the inlet portion of the development apparatus 12. In order to prevent this, the toner particles floating near the inlet portion of the development apparatus 12 are sucked by a duct. The gaps between the development apparatus 12 and the opposite ends of the photoconductor drum 11 are sealed by a conventional elastic material such as sponge.

In the above-mentioned embodiment of a development apparatus according to the invention, the developer feed magnetic roller is employed for supplying the developer to the development roller. However, instead of such a magnetic roller, any means such as a rotary impeller and other roller can be employed as well. Furthermore, by omitting the developer feed magnetic roller in the above-mentioned embodiment, the same results can be obtained.

What is claimed is:

1. In a magnetic brush development apparatus of the type comprising a plurality of magnetic rollers, each of which comprises a non-magnetic rotary sleeve and magnetic field generating means disposed in said non-magnetic rotary sleeve, and each of which successively transfers therebetween a magnetic developer carried on the surfaces of said sleeves for developing a latent electrostatic image on a photoconductor, wherein the improvement comprises means for forming a uniform magnetic brush comprising:

a developer regulating means for regulating the quantity of said magnetic developer on a first magnetic roller of said plurality of magnetic rollers by removing excess developer from the surface of the sleeve of said first roller, which first roller is disposed in close proximity to said photoconductor for transferring developer to and developing said latent electrostatic image;

a second magnetic roller of said plurality of rollers; rotatable in the same direction as said first magnetic roller for supplying said magnetic developer to said first magnetic roller in a transfer region and disposed with a predetermined space between it and said first magnetic roller such that the excess developer removed by said developer regulating means is received on the surface of the sleeve thereof upstream of said transfer region for resupplying said developer to said region; and said magnetic field generating means disposed in said first magnetic roller and said second magnetic roller are arranged so as to overlap the respective magnetic forces thereof in said transfer region in such manner as to remove an excessive amount of said magnetic developer from said region, through said space between said first and second magnetic rollers, on said sleeve of said second magnetic roller.

2. A magnetic brush development apparatus as claimed in claim 1, further comprising preliminary pressure plate means for adjusting the quantity of said magnetic developer on said first magnetic roller and for applying pressure to said magnetic developer, said plate means comprising:

a preliminary pressure plate being disposed in close proximity to said first magnetic roller and between said second magnetic roller and said developer regulating means;

a rotatable shaft;

means for urging said shaft to rotate in one direction; and wherein;

said preliminary pressure plate is fixed to and swingable on said shaft and has a first end portion on a developer inlet side and a second end portion on a developer outlet side and said second end portion is normally urged by said urging means to the surface of said first magnetic roller.

3. A magnetic brush development apparatus as claimed in claim 2, wherein said preliminary pressure plate is swingable by said urging means in accordance with the quantity of said magnet developer on the surface of said first magnetic roller and said end portions are disposed with respect to said surface such that the quantity of said magnetic developer which enters between said first magnetic roller and said preliminary pressure plate is regulated by said first end portion of said preliminary pressure plate and the height of a magnetic brush formed on said first magnetic roller is regulated by said second end portion of said preliminary pressure plate.

4. A magnetic brush development apparatus as claimed in claim 2, further comprising means for defining a feed-back route for returning excess magnetic developer, scrapped from said first magnetic roller by said developer regulating means, to said second magnetic roller, said defining means comprising said preliminary pressure plate and said developer regulating means.

5. A magnetic brush developing apparatus as in claim 1 wherein said transfer region is disposed relative to the center line connecting the centers of rotation of said first and second magnetic rollers, downstream with respect to the rotation of said first magnetic roller and upstream with respect to the rotation of said second magnetic roller.

6. A magnetic brush development apparatus for forming a uniform magnetic brush comprising:

development roller means for supplying a magnetic developer for developing a latent electrostatic image on a photoconductor, and comprising:

a first non-magnetic rotary sleeve; and first magnetic field generating means disposed in said first non-magnetic rotary sleeve; developer feed roller means for supplying said magnetic developer to said development roller means in a transfer region therebetween and comprising:

a second non-magnetic rotary sleeve rotatable in the same direction as and disposed with a predetermined space between it and said first rotary sleeve; and second magnetic field generating means disposed in said second non-magnetic rotary sleeve;

and wherein said first magnetic field generating means and said second magnetic field generating means are disposed such that the respective magnetic forces thereof overlap in said transfer region in such manner that a predetermined amount of said magnetic developer is transferred from said second rotary sleeve to said first rotary sleeve and the excess is removed on said second rotary sleeve through said predetermined space.

7. Apparatus as in claim 6 wherein said first and second magnetic field generating means comprise respective first and second magnets with opposite magnetic poles disposed toward each other and with their axes at an angle in the range from about 53° to 56° with a line connecting the rotational centers of said first and second rotary sleeves.

8. Apparatus as in claim 6 wherein said second magnetic fluid generating means comprises four magnets disposed with their magnetic poles alternately reversed and with 60° angles therebetween.

9. Apparatus as in claim 6 further comprising developer regulating means for regulating the quantity of said magnetic developer on said first rotary sleeve by removing excess developer from the surface of said first rotary sleeve and depositing it on the surface of said second rotary sleeve upstream of said transfer region.

10. Apparatus as in claim 6 further comprising preliminary pressure plate means for adjusting the quantity of said magnetic developer on said first rotary sleeve and comprising means for applying pressure to said magnetic developer.

* * * * *